United States Patent [19]

Schumacher

[11] 4,167,995

[45] Sep. 18, 1979

[54] APPARATUS FOR CHANGING THE DISTANCE BETWEEN ROWS OF CIGARETTES OR THE LIKE

[75] Inventor: Peter Schumacher, Hamburg-Stapelfeld, Fed. Rep. of Germany

[73] Assignee: Hauni-Werke Körber & Co. KG., Hamburg, Fed. Rep. of Germany

[21] Appl. No.: 795,562

[22] Filed: May 10, 1977

[30] Foreign Application Priority Data

May 21, 1976 [DE] Fed. Rep. of Germany ..... 2622713

[51] Int. Cl.[2] ..... B65G 47/26

[52] U.S. Cl. ..... 198/458; 131/25; 131/28; 198/480; 198/482; 198/608

[58] Field of Search ..... 198/458, 420, 478, 480, 198/482, 608; 131/25, 28, 93, 94

[56] References Cited

U.S. PATENT DOCUMENTS

| | | | |
|---|---|---|---|
| 3,098,552 | 7/1963 | Schulz | 198/480 |
| 3,286,815 | 11/1966 | Shuster et al. | 198/458 |
| 3,290,767 | 12/1966 | Mamie | 198/420 |
| 3,363,632 | 1/1968 | Gamberini | 198/420 |
| 3,370,514 | 2/1968 | Rome | 131/94 |
| 3,834,285 | 9/1974 | Schubert et al. | 131/94 |

FOREIGN PATENT DOCUMENTS

| | | | |
|---|---|---|---|
| 589257 | 12/1959 | Canada | 198/480 |
| 107034 | 8/1927 | Fed. Rep. of Germany | 198/480 |

*Primary Examiner*—Richard A. Schacher
*Attorney, Agent, or Firm*—Peter K. Kontler

[57] ABSTRACT

Apparatus for changing the spacing between two neighboring rows of parallel cigarettes which are transported sideways has a first fluted drum which delivers the two rows of cigarettes to a first transfer station where the cigarettes enter radially extending flutes in the upper end faces of two coplanar disks which are eccentric to each other and one of which surrounds the other disk. The disks transport the cigarettes through 180 degress to a second transfer station where the cigarettes are picked up by the flutes of a second fluted drum which is coaxial with the first drum. The distance between the two rows of cigarettes increases or decreases gradually during transport by the disks.

10 Claims, 3 Drawing Figures

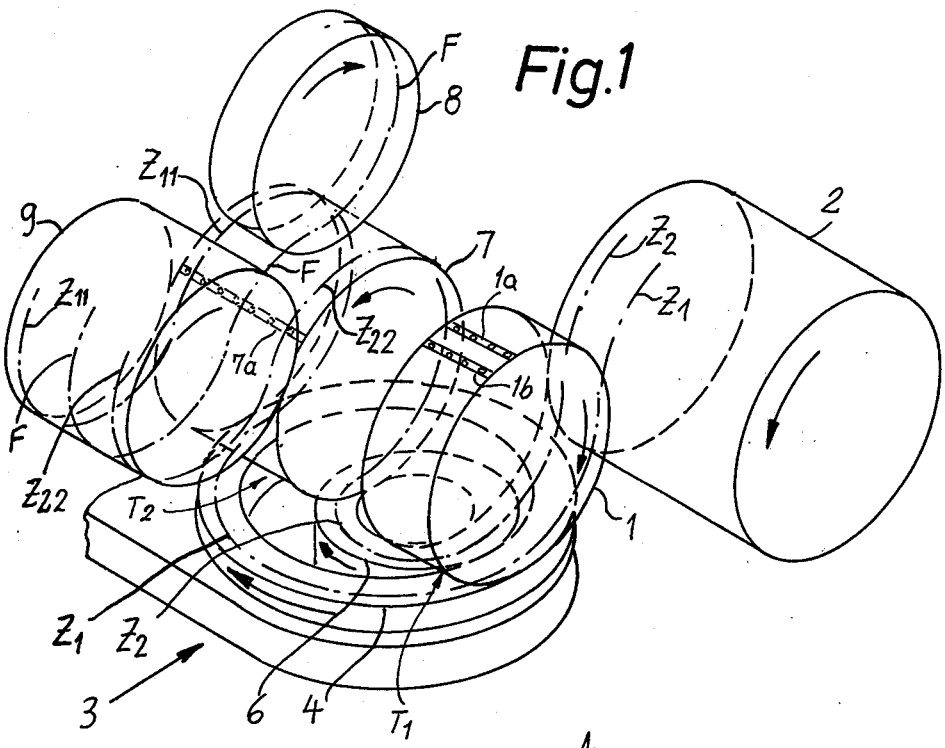
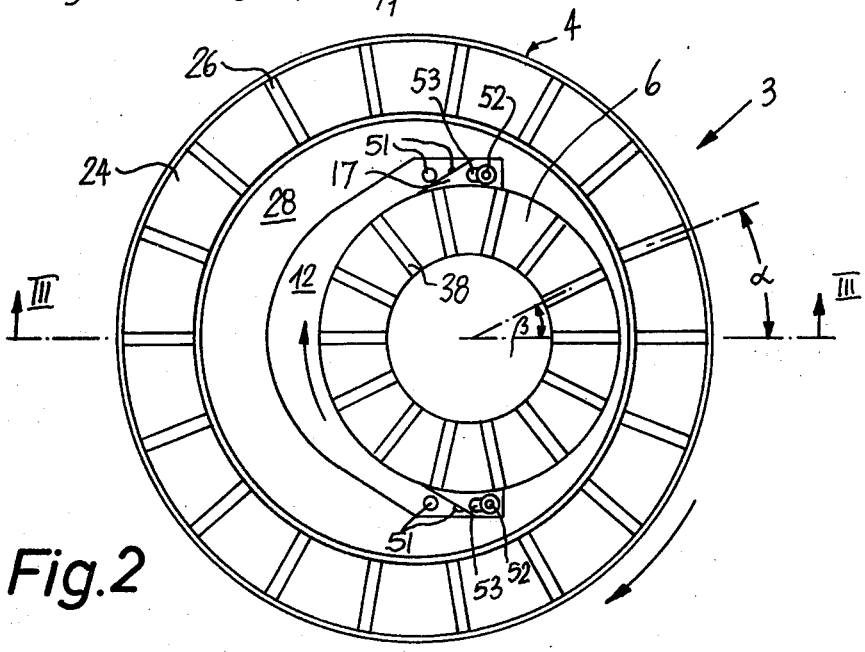
Fig.2

APPARATUS FOR CHANGING THE DISTANCE BETWEEN ROWS OF CIGARETTES OR THE LIKE

BACKGROUND OF THE INVENTION

The present invention relates to apparatus for manipulating cigarettes, cigars, cigarillos, filter rod sections or other rod-shaped articles which constitute or form part of smokers' products. More particularly, the invention relates to improvements in apparatus for changing the spacing between rows of elongated articles which move sideways. Apparatus of the just outlined character are normally employed in machines for the manufacture of filter-tipped smokers' products wherein tobacco-containing rod-shaped articles of pairs of such articles must be positioned at a predetermined distance from each other to provide room for insertion of filter rod sections therebetween.

The customary way of changing the distance between a pair of coaxial rod-shaped articles which move sideways is to cause the inner or the outer end faces of the articles to move along suitably inclined cams which compel the articles to move apart or nearer to each other. As a rule, the articles are held by suction in and extend from flutes or analogous receiving means so that the exposed portions of their end faces can be engaged by convergent or divergent cams. Such mode of changing the spacing between pairs of articles is acceptable as long as the articles are not transported at a relatively high speed. However, when the cams are to change the spacing between pairs of cigarettes which issue from a high-speed cigarette making machine, the cam-engaging portions of the end faces of cigarettes are likely to be defaced and/or damaged.

Other proposals to change the spacing between coaxial cigarettes or analogous smokers' products include the provision of two pairs of frustoconical fluted drums which are disposed between cylindrical article-receiving and cylindrical article-removing drums. Reference may be had to commonly owned U.S. Pat. No. 3,372,702 to Bohn et al. The bases of each pair of frustoconical drums are remote from each other. Such apparatus are reliable and do not deface or damage the articles because the flutes need not move relative to the articles or vice versa. However, the apparatus must comprise a large number of drums as well as complex and hence expensive bearings and drive means for the frustoconical drums.

Commonly owned U.S. Pat. No. 3,199,418 to Schubert discloses a further apparatus wherein the distance between neighboring rows of cigarettes or the like is changed by sets of fluted disks whose planes are inclined with respect to each other. The patented apparatus is suited practically exclusively for manipulation of relatively sturdy and rather short filter rod sections because the fact that the inclination of filter rod sections changes during transfer onto or from the disks does not affect their appearance and/or integrity. Manipulation of cigarettes (even relatively short cigarettes of unit length) in such apparatus is impractical or plain impossible because the weak and highly sensitive wrappers of cigarettes would be destroyed during transfer onto or from the respective sets of mutually inclined disks. Another drawback of the just described apparatus, as well as of the previously described apparatus, is that they cannot be readily converted for the manipulation of shorter or longer rod-sahped articles and/or for changing the extent to which the rows of rod-shaped articles are moved nearer to or further away from each other. This reduces the versatility and contributes to the cost of machines (particularly filter cigarette makers) wherein the apparatus are put to use. Each and every conversion necessitates the replacement of previously used pairs of frustoconical drums or sets of mutually inclined disks with different drums or disks.

OBJECTS AND SUMMARY OF THE INVENTION

An object of the invention is to provide an apparatus which can reliably and reproducibly change the spacing between rows of parallel articles while the articles move sideways, wherein such changes in spacing can be effected by resorting to a relatively small number of simple and sturdy parts, and which can be installed in existing filter cigarette making or other machines as a superior substitute for conventional apparatus.

Another object of the invention is to provide an apparatus which can manipulate cigarettes or analogous smokers' products without any deformation and/or defacing and which can be rapidly converted for manipulation of shorter or longer articles and/or to change the extent to which the articles of neighboring rows are moved nearer to or further away from each other.

An additional object of the invention is to provide the apparatus with a novel and improved system of conveyors which are of simple construction, which occupy little room in a filter cigarette maker or the like, and which can complete the change in spacing between neighboring rows of articles during travel of articles along relatively short paths.

The invention is embodied in an apparatus for changing the spacing between rows of substantially parallel elongated articles, such as cigarettes, cigarillos, cigars or filter rod sections. The apparatus comprises a first conveyor (e.g., a rotary drum) having means (such as flutes) for advancing several rows of articles along a first path to a first transfer station, and a second conveyor having a plurality of conveying or transporting devices each of which defines a discrete second path for a different one of the rows. The second paths extend from the first transfer station to a second transfer station and each transporting device has a plurality of flutes or analogous receiving means for the articles. The transporting devices are rotatable about parallel or substantially parallel axes and the receiving means of each device are substantially coplanar and extend substantially radially of the respective axis whereby the distance between the rows of articles in the second paths varies during movement of the articles from the first to the second transfer station. The apparatus further comprises a third conveyor having flutes or analogous means for receiving the rows at the second transfer station and for transporting the rows along a third path. The third conveyor may constitute a rotary drum which is coaxial with the first conveyor but is rotated in the opposite direction. Each conveyor is preferably driven continuously rather than stepwise.

The transporting devices preferably constitute or comprise annuli having different diameters. If the apparatus is to change the spacing between two rows of articles, the annuli include a larger-diameter annulus and a smaller-diameter annulus which is eccentric to and is disposed within the confines of the larger-diameter annulus. If the first and third paths are substantially circular paths, the planes of the receiving means of the transporting devices are preferably tangential to the circular paths, i.e., such planes are parallel to the common axis of the first and third conveyors. All receiving means are preferably (but need not be) located in a common plane.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 1 is a schematic perspective view of an apparatus which embodies the invention and is designed to change the distance between two rows of cigarettes as well as to assemble the cigarettes with filter rod sections.

FIG. 2 is a plan view of the distance-changing second conveyor in the apparatus of FIG. 1.

DESCRIPTION OF THE PREFERRED EMBODIMENTS

Figure 3:
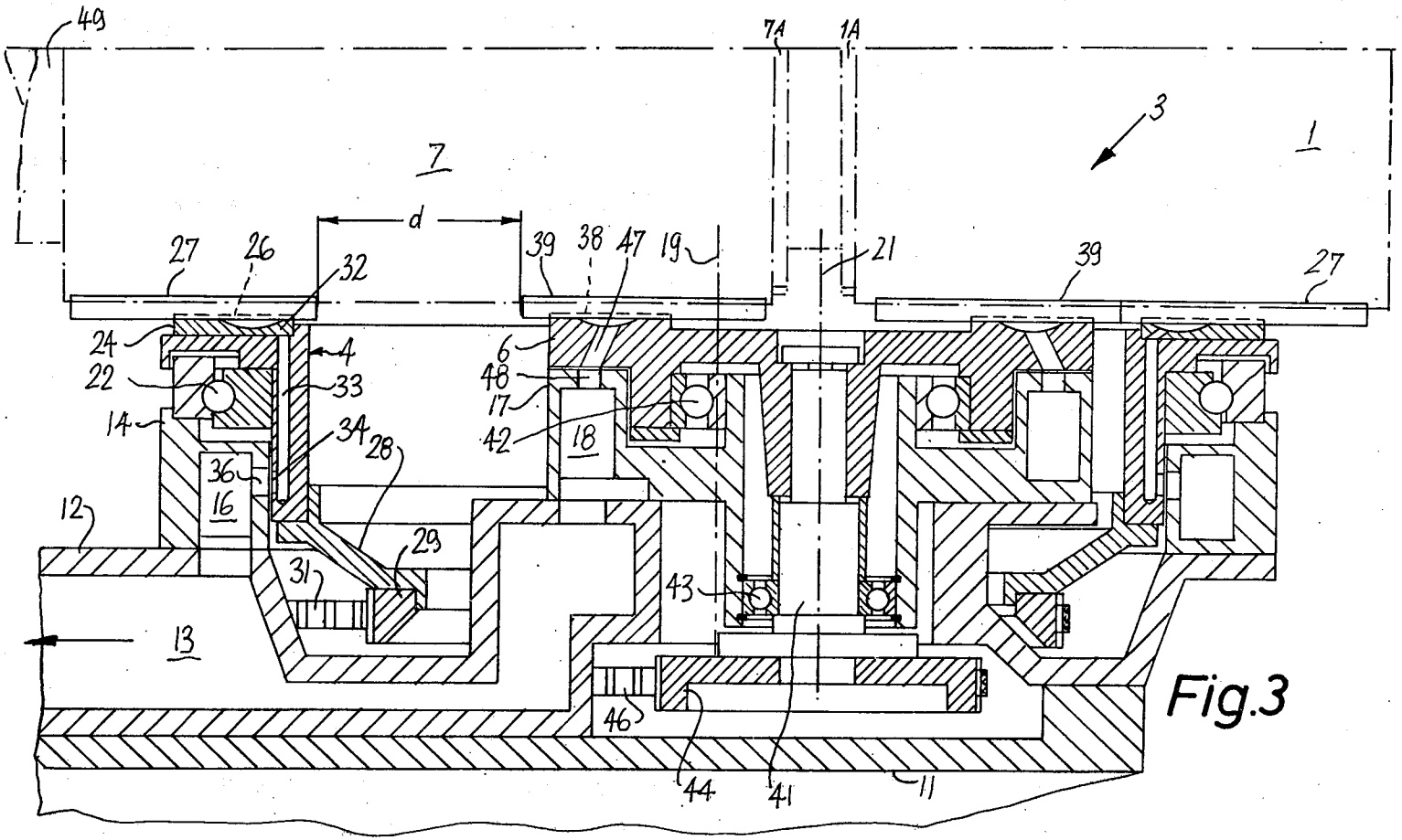
FIG. 3 is an enlarged sectional view as seen in the direction of arrows from the line III—III of FIG. 2.

FIG. 1 shows an apparatus which comprises an endless first conveyor 1 here shown as a rotary drum having peripheral flutes 1*a* which are equally spaced from each other and each of which receives two closely adjacent plain cigarettes 27, 39 (shown in FIG. 3). The flutes 1*a* of the conveyor 1 receive pairs of cigarettes from a row forming conveyor 2 of the type normally employed in cigarette making machines to convert a single file of discrete coaxial plain cigarettes into one or more rows wherein the cigarettes are parallel to each other and move sideways. The endless circular path for the two rows of cigarettes on the conveyors 1 and 2 is indicated by the phantom lines $Z_1$ and $Z_2$. The row in the path $Z_1$ consists of equally spaced parallel cigarettes 27, and the row in the path $Z_2$ consists of equally spaced parallel cigarettes 39. The flutes 1*a* of the conveyor 1 communicate with suction ports 1*b* which are connected to a suction generating device during travel from the transfer station between the conveyors 1, 2 to a transfer station $T_1$ where the flutes 1*a* deliver cigarettes 27 and 39 to an intermediate or distance-changing conveyor 3. The latter changes (increases) the spacing between the two rows of cigarettes so that the width of the space or gap between such rows is sufficient to allow for insertion of a filter rod section of double unit length between each pair of coaxial cigarettes 27 and 39. The extent to which the distance between the two rows is increased (from zero to d) can be seen in FIG. 3.

A further endless conveyor 7 (preferably a rotary drum) receives the cigarettes 27 and 39 of the two spaced-apart rows from the conveyor 3 and transports such rows along an arcuate path which is denoted by the phantom lines $Z_{11}$ and $Z_{22}$. The transfer station between the conveyors 3 and 7 is shown at $T_2$. The conveyor 7 is the assembly conveyor of a filter cigarette making machine and cooperates with a rotary drum-shaped conveyor 8 serving to deliver a single row of filter rod sections of double unit length. The path along which the filter rod sections of the single row advance toward and beyond the transfer station between the conveyors 7 and 8 is denoted by the phantom line F. Each filter rod section is caused to enter the gap between two coaxial plain cigarettes 27, 39 so that the pairs of cigarettes and the respective filter rod sections form a series of groups of three coaxial rod-shaped articles each. Such groups are thereupon transferred onto a further rotary drum-shaped conveyor 9 whereon the filter rod sections are connected to the respective pairs of cigarettes 27, 39 by uniting bands to form filter cigarettes of double unit length. The manner in which filter cigarettes of double unit length are converted into filter cigarettes of unit length and the filter cigarettes of unit length are caused to form a single row, tested for integrity of their wrappers and/or ends and transported to a packing machine or into storage forms no part of the invention.

The arrows indicate the directions of rotation of the conveyors 1, 2, 7, 8 and 9. The conveyors 1 and 7 are coaxial but are driven to rotate in the opposite directions. As shown (very schematically) in FIG. 3, the common horizontal shaft 49 for the conveyors 1 and 7 is surrounded by gears 1A and 7A which transmit torque to the respective conveyors. The manner in which the conveyor 2 forms rows of cigarettes is disclosed, for example, in commonly owned German Offenlegungsschrift No. 1,912,652. The manner in which the conveyor 8 delivers filter rod sections to an assembly conveyor is disclosed, for example, in commonly owned German Offenlegungsschrift No. 2,250,267.

In accordance with a feature of the invention, the conveyor 3 comprises two annular transporting or conveying devices 4 and 6 which are respectively provided with radially extending horizontal receiving means 26 and 38 (preferably flutes) for cigarettes 27 and 39. The smaller-diameter transporting device 6 is eccentric to and is located within the confines of the larger-diameter transporting device 4 (see particularly FIGS. 2 and 3). The axes 19, 21 (FIG. 3) of the devices 4 and 6 are parallel to each other and are normal to the common axis of the conveyors 1, 7. In the illustrated embodiment, the flutes 26, 38 are disposed in a common plane which is parallel to the axis of the shaft 49, i.e., such plane is substantially tangential to the peripheries of the drum-shaped conveyors 1 and 7. The transporting device 4 defines a first semicircular path along which the cigarettes 27 are moved from the station $T_1$ to the station $T_2$, and the device 6 defines a discrete second semicircular path along which the cigarettes 39 are moved between such stations.

For the sake of clarity, FIG. 3 shows the stationary parts of the conveyor 3 with hatching consisting of widely spaced-apart oblique lines. The hatching representing moving parts consists of closely adjacent oblique lines. The conveyor 3 comprises a stationary frame member or bracket 11 which is rigid with a support 12 for a ring-shaped carrier 14. The support 12 is formed with a suction channel 13 which is in communication with the intake of a fan or another suitable suction generating device, not shown. The carrier 14 has an annular suction chamber 16 which communicates with the channel 13. The stationary parts of the conveyor 3 further include a sleeve-like carrier 17 which is eccentric to the carrier 14 and has a ring-shaped suction chamber 18 in communication with the channel 13 of the support 12.

The larger-diameter annular transporting device 4 is mounted on the inner race of a four-point antifriction ball bearing 22 whose outer race is affixed to the carrier 14. The transporting device 4 includes a ring 24 which is formed with the flutes 26 and a turntable 28 having a ring gear 29 driven by a toothed belt 31. Each flute 26 has one or more ports 32 in communication with ports 33 and 34 in the median portion of the device 4. The ports 34 communicate with the suction chamber 16 by way of an arcuate groove 36 in the carrier 14 during travel of the respective flutes 26 between the transfer stations $T_1$ and $T_2$.

The smaller-diameter transporting device 6 has an upper end face which is formed with the flutes 38 and is affixed to a shaft 41 (the axis of this shaft coincides with the aforementioned axis 21) which is rotatable in anti-friction ball bearings 42, 43 mounted in the carrier 17. The shaft 41 is rigid with a gear 44 which is driven by a toothed belt 46. Each flute 38 communicates with one or more ports 47 which communicate with the suction chamber 18 by way of an arcuate groove 48 in the carrier 17 during travel of the respective flute 38 between the transfer stations $T_1$ and $T_2$.

In order to convert the conveyor 3 for transport of rows containing cigarettes of different lengths and/or to change the spacing (d) between the cigarettes in the flutes 7*a* of the conveyor 7, the carrier 17 for the transporting device 6 is shiftable sideways with respect to the support 12 in parallelism with the common axis of the conveyors 1 and 7. To this end, the support 12 is formed with two rows of tapped holes 51 (see FIG. 2) for screws 52 or analogous fasteners extending through elongated slots 53 of the carrier 17. In order to change the eccentricity of the device 6 relative to the device 4, the screws 52 are loosened and the carrier 17 is adjusted to the extent permitted by the length of the slots 53 before the screws 51 are reapplied to prevent further shifting of the carrier 17 relative to the support 12. If the desired extent of adjustment is larger than that permitted by the slots 53, the screws 52 are removed and introduced into a different pair of holes 51. It is also within the purview of the invention to install the device 6 in the support 12 against any sidewise movement and to provide means for adjustably securing the carrier 14 to the support 12.

FIG. 2 shows that the ring 24 of the larger-diameter transporting device 4 has 18 equally spaced flutes 26, i.e., the angle alpha between the centers of two neighboring flutes equals 360°/18. The transporting device 6 has 14 equally spaced flutes 38 so that the angle beta between the centers of two neighboring flutes 38 equals 360°/14. The transmission which includes the toothed belts 31 and 46 drives the transporting devices 4 and 6 at different speeds. The ratio of such speeds equals 18:14 or beta to alpha. The smaller-diameter transporting device 6 is driven at a higher speed.

The operation:

The conveyor 2 receives pairs of coaxial plain cigarettes 27, 39 of unit length from the cigarette making machine and delivers the thus formed rows of cigarettes along the path denoted by the lines $Z_1$ and $Z_2$ to the transfer station between the conveyors 1, 2 where the cigarettes are delivered into the flutes 1*a* to be advanced toward the transfer station $T_1$. One end face of each cigarette 27 abuts against or is closely adjacent to the corresponding end face of the aligned cigarette 39. Successive cigarettes 27 enter successive flutes 26 of the larger-diameter transporting device 4 and successive cigarettes 39 enter successive flutes 38 of the smaller-diamter transporting device 6 within the confines of the device 4. Due to the aforementioned ratio of the speed of the device 4 to the speed of the device 6, successive flutes 26 register with successive flutes 38 at the transfer station $T_1$. During travel with the flutes 26 and 38, the distance between the two rows of cigarettes 27 and 39 gradually increases due to eccentricity of the device 6 with respect to the device 4 so that such distance reaches the value d at the second transfer station $T_2$ which (in the illustrated embodiment) is located diametrically opposite the station $T_1$ (with reference to the axis 19 of the transporting device 4). The increase in distance between the cigarettes 27, 39 which are transported from the station $T_1$ toward the station $T_2$ takes place gradually and in such a way that there is hardly any or no sliding contact between the neighboring end faces of such cigarettes immediately after transfer into the adjacent flutes 26 and 38. Since the number of flutes 26 exceeds the number of flutes 38 (i.e., the angle beta is larger than the angle alpha), the cigarettes 27, 39 which were in exact axial alignment with each other become staggered (as considered in the circumferential direction of the devices 4, 6) during transport toward the station $T_2$, i.e., a cigarette 27 which was in register with a first cigarette 39 at the station $T_1$ registers with a different cigarette 39 at the station $T_2$. The flutes 7*a* of the conveyor 7 are also formed with suction ports so that they accept successive pairs of aligned cigarettes 27, 39 at the station $T_2$, and advance the cigarettes toward the transfer station for the filter rod sections which are fed by the conveyor 8. The thus obtained groups of three coaxial rod-shaped articles each are transferred onto the conveyor 9 for further processing, i.e., for conversion into filter cigarettes of double unit length.

An important advantage of the improved apparatus is that it occupies little room and that it consists of a small number of relatively simple parts. Furthermore, the spacing between the rows of cigarettes or analogous articles can be changed within any desired practical range, and the distance between the neighboring rows of articles can be changed without any damage to the articles and/or without affecting their appearance. Still further, the distance between neighboring rows of cigarettes can be changed at the speed which is required to process the entire output (e.g., 4000 cigarettes per minute) of a modern cigarette maker or the like. Delicate manipulation of articles during transfer onto and from the transporting devices 4 and 6 is insured because the articles are held against any movement relative to the flutes 26 and 38 during transport from the station $T_1$ to the station $T_2$.

It is further clear that the improved apparatus can be readily modified for simultaneous transport of three or more rows of rod-shaped articles as well as that the conveyor 3 can be designed and operated to reduce the spacing between neighboring rows of articles. For example, the conveyor 7 could furnish two rows of cigarettes or other rod-shaped articles to the station $T_2$ and the distance between such rows would be reduced during transport of articles from the station $T_2$ to the station $T_1$. Still further, the conveyor 1 need not deliver rows of articles in such a way that the end faces of articles forming one of the rows abut against the adjacent end faces of articles forming the neighboring row. Moreover, it is not necessary to dispose the transfer stations $T_1$ and $T_2$ diametrically opposite each other. By appropriate selection of the number of flutes on the devices 4, 6 and the speeds of such devices, the angular distance which is covered by articles during travel along the paths defined by the devices 4 and 6 may be less or more than 180 degrees. Finally, it is not even necessary to place the flutes 26 into a common plane with the flutes 38. If the two groups of flutes are located in different planes, the conveyor 1 must include a larger-diameter section which delivers cigarettes to the flutes which are located at a greater distance from the axis of the shaft 49 and a smaller-diameter section which delivers cigarettes to the other group of flutes. However, the illustrated construction is simpler and takes up less room in a filter cigarette making machine or the like.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the claims.

What is claimed is:

1. Apparatus for changing the spacing between rows of substantially parallel elongated articles, such as cigarettes, comprising a first conveyor having means for advancing several rows of articles sideways along a first path to a first transfer station; a second conveyor having a plurality of transporting devices each defining a discrete second path for a different one of said rows, said devices including annuli having different diameters and said annuli including a larger-diameter annulus and a smaller-diameter annulus eccentric to and disposed within the confines of said larger-diameter annulus, and second paths extending from said first to a second transfer station and each of said devices having a plurality of receiving means for the articles of the respective row, said devices being rotatable about substantially parallel axes and the receiving means of each of said devices being substantially coplanar and extending substantially radially of the respective axis so that the elongated articles which are admitted into successive receiving means at said first station also extend substantially radially of the axes of the respective transporting devices whereby the distance between the rows in said second paths, as considered in the longitudinal direction of the articles, varies during movement from said first to said second station; and a third conveyor having means for receiving said rows at said second station and for advancing the articles of said rows sideways along a third path.

2. Apparatus as defined in claim 1, further comprising means for continuously driving said conveyors.

3. Apparatus as defined in claim 1, wherein the number of receiving means in said larger-diameter annulus exceeds the number of receiving means in said smaller-diameter annulus, and further comprising means for respectively rotating said larger-diameter and smaller-diameter annuli at different first and second speeds whose ratio equals $\alpha:\beta$ wherein $\alpha$ is the angular distance between neighboring receiving means of said larger-diameter annulus and $\beta$ is the angular distance between neighboring receiving means of said smaller-diameter annulus.

4. Apparatus as defined in claim 1, wherein said first and third paths are substantially circular paths and the planes of said receiving means are substantially parallel to the axes of said circular paths.

5. Apparatus as defined in claim 4, wherein said first and third conveyors include coaxial endless conveyors.

6. Apparatus as defined in claim 4, wherein all of said receiving means are disposed in a common plane.

7. Apparatus as defined in claim 1, wherein each of said first and third conveyors is an endless rotary conveyor and further comprising means for rotating said rotary conveyors about a common axis but in opposite directions.

8. Apparatus as defined in claim 1, wherein at least one of said annuli is movable substantially at right angles to the respective axis between a plurality of positions and further comprising means for holding said one annulus in a selected position.

9. Apparatus as defined in claim 1, wherein said receiving means are flutes.

10. Apparatus as defined in claim 1, wherein said receiving means are horizontal and said first and third conveyors are fluted drums having a common horizontal axis.

* * * * *